US005437388A

United States Patent [19]

Bartelt et al.

[11] Patent Number: 5,437,388

[45] Date of Patent: Aug. 1, 1995

[54] CONTAINER

[75] Inventors: Frederick W. Bartelt, Jeffersontown, Ky.; David F. Gillard, Woodstock, Ga.; James G. Harbison, McComb, Miss.; Achim R. Lorenz, Dickson, Tenn.

[73] Assignee: MacMillan Bloedel Packaging, Inc., Montgomery, Ala.

[21] Appl. No.: 341,214

[22] Filed: Dec. 5, 1994

[51] Int. Cl.[6] ..... B65O 5/56

[52] U.S. Cl. ..... 220/416; 220/410; 220/441

[58] Field of Search ..... 220/408, 410, 416, 418, 220/441; 229/109

[56] References Cited

U.S. PATENT DOCUMENTS

| | | | |
|---|---|---|---|
| Re. 33,128 | 12/1989 | Nordstrom . | |
| 2,077,174 | 4/1937 | Hyndman . | |
| 2,326,817 | 8/1943 | Zalkind | 220/418 |
| 3,041,942 | 7/1962 | Repking . | |
| 3,317,034 | 5/1967 | Bowles et al. | 220/441 |
| 3,883,065 | 5/1975 | Presnick | 220/416 |
| 3,937,392 | 2/1976 | Swisher | 220/410 |
| 3,957,179 | 5/1976 | Bamburg . | |
| 4,013,168 | 3/1977 | Bamburg . | |
| 4,166,567 | 9/1979 | Beach . | |
| 4,341,337 | 7/1982 | Beach, Jr. et al. | 220/408 |
| 4,421,253 | 12/1983 | Croley . | |
| 4,706,809 | 11/1987 | Halsell | 220/441 |
| 4,742,951 | 5/1988 | Kelly et al. | 220/441 |
| 4,834,255 | 5/1989 | Boots . | |
| 4,850,506 | 7/1989 | Heaps, Jr. et al. | 220/441 |
| 5,147,271 | 9/1992 | Bacques et al. . | |
| 5,351,849 | 10/1994 | Jagenburg et al. | 220/441 |

*Primary Examiner*—Gary E. Elkins
*Attorney, Agent, or Firm*—Shlesinger Arkwright & Garvey

[57] ABSTRACT

The container is formed preferably from three telescoping sleeves, the inner sleeve having at least two sets of adjacent walls with the center wall of each set being provided with a wide flap that extends beyond the sides of the center wall and is formed with a stepped lateral edge on each of its sides. These flaps being foldable into a position substantially perpendicular to the axis of the sleeve and the steps cooperate with edges of walls adjacent the sets to hold the sleeve in its desired cross sectional shape. A second sleeve surrounds the first sleeve and has alternating long and short side wall with long side walls in face to face relationship with the steps or other edges on the flaps.

Preferably, a substantially rectangular cross section sleeve surrounds the two inner sleeves and the inner periphery of the rectangular cross section sleeve at its corresponding ends will have a width substantially equal to the width of the wide flaps.

8 Claims, 3 Drawing Sheets

CONTAINER

FIELD OF INVENTION

The present invention relates to a container, more particularly, the present invention relates to a laminated container formed by a plurality of telescoped sleeves.

BACKGROUND OF THE INVENTION

The use of a plurality of discrete tubes or sleeves telescoped to form a laminated strengthened sleeve as the main body portion of a container is well known.

One of such containers currently on sale in the United States is described in reissue patent 33128 issued Dec. 12, 1989 to Nordstrom. This particular container utilizes a pair of telescoping sleeves provided with end caps to further reinforce the container. The container is provided with a bag and fitment wherein the fitment is interlocked with a wall of the sleeves to prevent rotation. The interaction between the cap and the sleeved walls (i.e. the flaps are received between the sleeves) is used to help to reinforce the structure.

U.S. Pat. Nos. 3,041,942 issued Jul. 3, 1962 to Repking; 4,166,567 issued Sep. 4, 1979 to Beach; 3,937,392 issued Feb. 10, 1976 to Swisher; 3,957,179 issued May 18, 1976 to Bamburg; and 4,421,253 issued Dec. 20, 1983 to Croley, each disclose the type of container generally formed by telescoped tubes with end caps to provide a large container for bulk materials.

The use of interlocking flaps on a cap is further shown in U.S. Pat. No. 2,077,174 issued Apr. 13, 1937 to Hyndman and the formation of a container, generally from a octagonal sleeves wherein the outer periphery of the outer sleeve or the base is formed as a rectangle as shown in U.S. Pat. No. 4,834,255 issued May 30, 1989 to Boots. U.S. Pat. No. 4,013,168 issued Mar. 22, 1977 to Bamburg, utilizes a rectangular sheet as an insert to be interfolded with the flaps (generally the bottom flaps) to lock the rectangular sheet into position and provide a rectangular base plate substantially the same size as the surface of the supporting pallet.

U.S. Pat. No. 5,147,271 issued Sep. 15, 1992 to Bacques et al., discloses a multi-wall container wherein the flaps at the ends of some of the walls are wider than the walls to which they are attached and are used to cover substantially this whole open area of a multi-sided sleeve.

BRIEF DESCRIPTION OF THE PRESENT INVENTION

It is an object of the present invention to provide a container wherein a flap on one wall of an inner sleeve cooperates with edges on other walls of the sleeve and/or on a surrounding sleeve to reinforce the integrity and define the shape of the canon prior to filling.

Broadly, the present invention relates to a container comprising an inner sleeve formed by a plurality of foldably interconnected walls, at least one group of three adjacent of said walls composed of a center wall and a pair of laterally adjacent walls positioned one on each side of the center wall, a flap foldably connected to said center wall along one end thereof, said flap having a width wider than said center wall and extending symmetrically laterally on opposite sides of said center wall, a step formed on each lateral edge of said flap, said set of three walls being shorter than immediately adjacent walls of said inner sleeve positioned on the sides of said laterally adjacent walls remote from said center wall thereby to provide a pair of abutment edges one formed at the end of each of said immediately adjacent walls by an edge of each of said immediately adjacent walls adjacent to said step and flap, said the widths of each of said laterally adjacent walls and the angles between the walls of said group of walls being correlated to ensure that an edge formed by each of said steps is in a substantially abutting relationship with its respective adjacent of said abutment edges when said sleeve is erected and said flap is folded into a position substantially perpendicular to the axis of said sleeve.

Preferably, a second sleeve will surround said inner sleeve and said second sleeve will be formed by panels forming walls, said panels forming walls corresponding to and overlying said laterally adjacent walls of said inner sleeve each have a length measured axially of said sleeve shorter than their respective adjacent panels forming walls to form second pair of abutment edges at an end of said second sleeve adjacent to said flap and one of said second pair of abutment edges being formed by a side of its respective of a pair of adjacent panels positioned on opposite sides of and adjacent to said short panel, one of said second pair of abutment edges at one side of said short panel being in position to engage said stepped lateral edges.

Preferably, said wide flap will be substantially rectangular with one edge defined along a central portion thereof by a fold line connecting said flap with said center wall and said wide flap have a width corresponding in width to a wall panel of a rectangular outer sleeve encircling said second sleeve.

Preferably, the said inner sleeve will form a substantially octagonal cross-section and there will be two of said group of three walls positioned in opposed mirror relationship to each other across said inner sleeve.

Preferably, said second sleeve will have a corresponding number of panels forming walls to those in said inner sleeve and will be provided with short walls corresponding with each of said short walls of said inner sleeve.

BRIEF DESCRIPTION OF THE DRAWINGS

Further feature, objects and advantages will be evident from the following detailed description of the preferred embodiments of the present invention taken in conjunction with the accompanying drawings in which.

DESCRIPTION OF THE PREFERRED EMBODIMENTS

Figure 1:
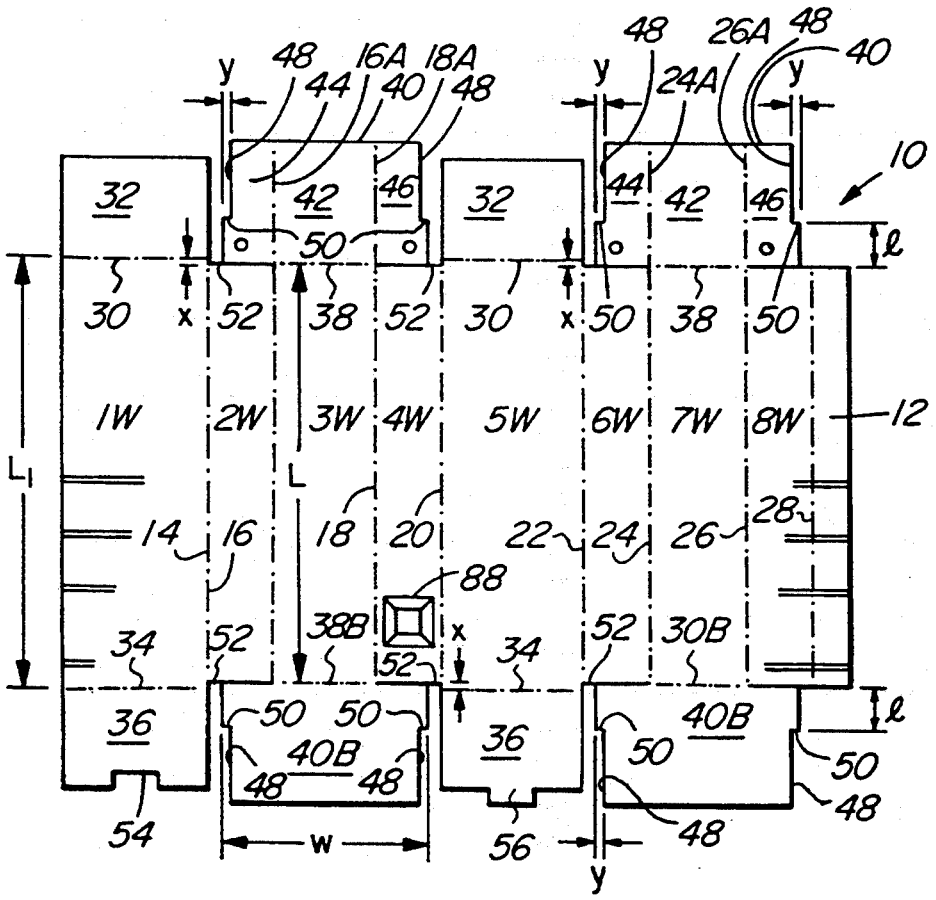
FIG. 1 is a plan view of a blank used to form an inner sleeve.

As shown in FIG. 1, the inner sleeve forming blank 10 is composed of eight wall forming panels indicated at 1W, 2W, 3W, 4W, 5W, 6W, 7W and 8W plus a glue flap 12, all foldably interconnected by set of substantially parallel fold lines 14, 16, 18, 20, 22, 24, 26 and 28 respectively. In the illustrated arrangement, the wall 1W and 5W have the same widths, 3W and 7W, the same widths and 2W, 4W, 6W and 8W the same width.

Connected to the free ends of the wide walls 1W and 5W via fold lines 30, are top flaps 32 and to the bottom of each of these walls via fold lines 34 are flaps 36.

The walls 2W, 3W and 4W form one group of three adjacent walls while the walls 6W, 7W and 8W form a second group of three wall which in the erected carton would be in opposed relationship to the walls 4W, 3W and 2W respectively. Each of these groups of three walls have an axial length L which is shorter than the axial length $l_1$ of the walls 1W and 5W by a distance equal to 2x, where x is the distance above or below the ends of the walls forming the two groups of three are relative to their adjacent walls, 1W and 5W, as defined by the fold lines 30 and 34.

Connected to each of the walls, 3W and 7W by a fold line 38 are top flaps 40. Each of these top flaps is divided via extensions of the fold lines 16, 18 or 24 and 26 defining the line of demarcation between the center wall such as wall 3W and its adjacent walls 2W and 4W respectively, i.e. via extensions of fold lines 16 and 18 as indicated at 16A and 18A for the flap 40 connected to the wall 3W and extension of fold lines 24 and 26 indicated at 24A and 26A for the flap 40 connected to the wall 7W to form each of the flap 40 into three portions, namely a center portion 42 connected via a fold line 38 to wall 3W or 7W and two side portions 44 and 46 which are connected to the center portion via fold line 16A, 18A, or 24A or 26A.

Each of the side portions, 44 and 46, are symmetrical relative to their respective center portions 42 and each has step lateral edge 48 formed with a step 50 to provide a wider portion of the flap portions 44 and 46 adjacent to the fold line 38 as indicated by the dimension y.

The dimensions x and y will generally be based in part, at least on the thickness of the board used to form the sleeves. For example, the dimension x will normally be equal to approximately the thickness (generally slightly more) of the board from which the blank 10 is formed, and the step 50, i.e. dimension y will generally be about equal to the combined thicknesses of the blank 10 and 60.

The spacing or length l, of the step portion, i.e. distance between the step 50 and the top of its respective adjacent wall 2W, 4W, 6W or 8W respectively is dimensioned to ensure that the step 50 comes into face to face relationship with its adjacent edge 52 of its adjacent longer wall 1W, 5W, when the sleeve 10A (see FIGS. 4 and 6) is formed from the blank 10 so that the sleeve retains its desired octagonal shape, i.e. the free edge 52 has a length measured in the axial direction substantially equal to x.

The bottom flap 40B which are connected to the bottom edge of the respective walls 3W and 7W via fold line 38B are essentially the same as the flap 40 except that there is no requirement to extend the fold lines to divide the flap into three different portions although this could be done if desired.

The flaps 36 are provided one with a suitable undercut notch 54 and the other with an undercut tongue 56 which latch together to holds sleeve in an erected form.

In the illustrated arrangement, a suitable foldable aperture 88 is formed in the wall 4W, to receive the fitment of a bag (not shown) which may be contained in a well known manner.

To form the sleeve 10A (see FIGS. 4 and 6) from the blank 10, the glue flap 12 is adhered to the wall 1W to form the sleeve 10A which is opened into its desired octagonal cross-section by opening or spreading the walls and held in this position by folding the flaps 40B into a position substantially perpendicular to their respective walls 3W and 7W, i.e. perpendicular to the longitudinal axis of the sleeve 10A so that the lateral portions of the flaps 40B overlap the free edges or free bottom edges of their adjacent walls 2W, 4W, or 6W, 8W respectively and their notches or steps 50 come into a butting relationship with the edges 52 of the adjacent walls 1W and 5W respectively which inherently ensures that the sleeve 10A assumes its desired octagonal shape. The flaps 36 are folded into perpendicular position relative to their respective walls 1W and 5W on the fold lines 34.

The extension fold lines 16A and 18A permit the portions 44 and 46 of each of the top flaps 40 to be folded into a position substantially plainer with their adjacent walls 2W, 4W, 6W and 8W respectively, so that a second sleeve 60A (see FIGS. 4 and 6) may be slid over the erected sleeve formed from the blank 10.

Figure 2:
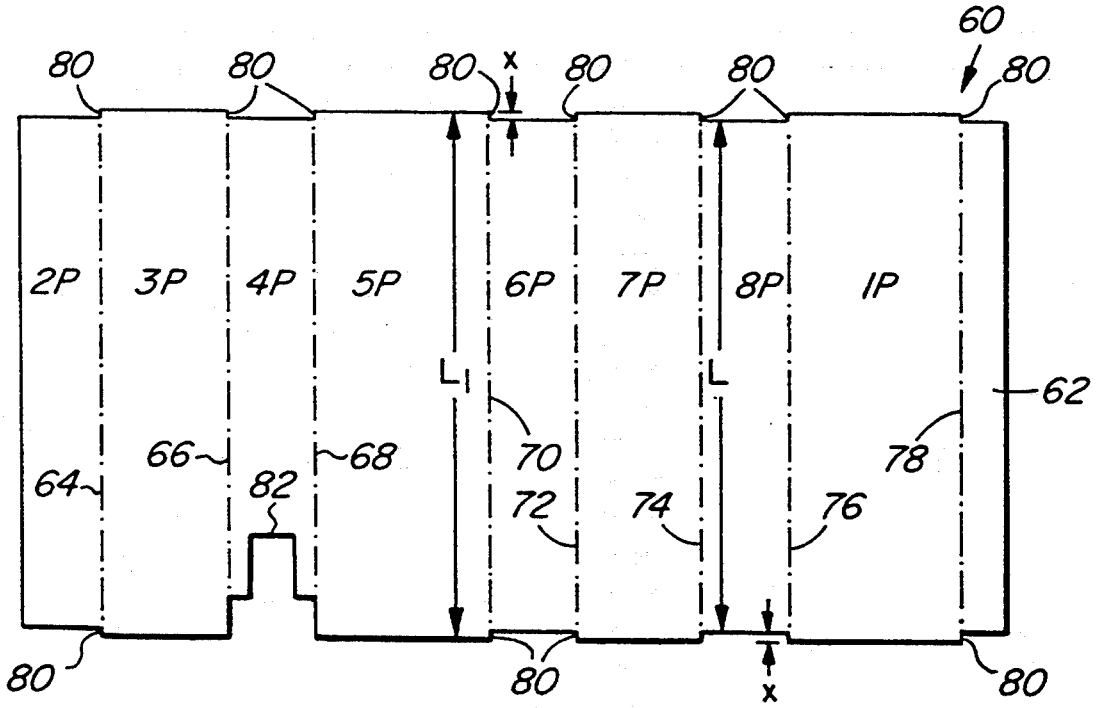
FIG. 2 is a plan view of a blank adapted to form a second sleeve.

As shown in FIG. 2, an intermediate sleeve forming blank is formed by a plurality of wall forming panel which have been given panel numbers the same as the wall numbers in which they will be positioned in face to face relationship in the finished carton. Thus, as illustrated, the blank 60 is formed by wall forming panels 2P, 3P, 4P, 5P, 6P, 7P, 8P and 1P plus a glue flap 62, all foldably interconnected via a set of substantially parallel fold line, 64, 66, 68, 70, 72, 74, 76 and 78 respectively.

The wider walls 1P and 5P have lengths $l_1$ which corresponds with the length $l_1$ of the corresponding panels 1W and 5W. The center panels 3P and 7P, which corresponds with center walls 3W and 7W, also have length $L_1$ which is of course longer than their corresponding wall 3W and 7W. However, the panels 2P, 6P and 8P, all have length L shorter than the length $L_1$ via distance equal to 2x where x is the distance the adjacent walls project beyond their respective walls 2P, 6P and 8P to form the abutment faces 80.

The top edge of wall 4P is stepped from the top edges of adjacent panels 3P and 5P by the distance x to form a pair of abutment edges 80. However, adjacent to the bottom edge of panel 4P is specially formed with a cutout as indicated at 82 to receive a fitment of a bag that may be inserted into the inner sleeve 10A with the fitment (not shown) projecting through the fitment aperture formed in the conventional manner as indicated at 88.

The sleeve 60A (see FIGS. 4 and 6) is formed from the sleeve blank 60 by gluing the glue flap 62 to the wall 2P and erected into the substantially octagonal cross-section The sleeve 60A is slid down around the inner sleeve 10A formed by the blank 10 to provide a double wall sleeve as will be described hereinbelow.

Figure 3:
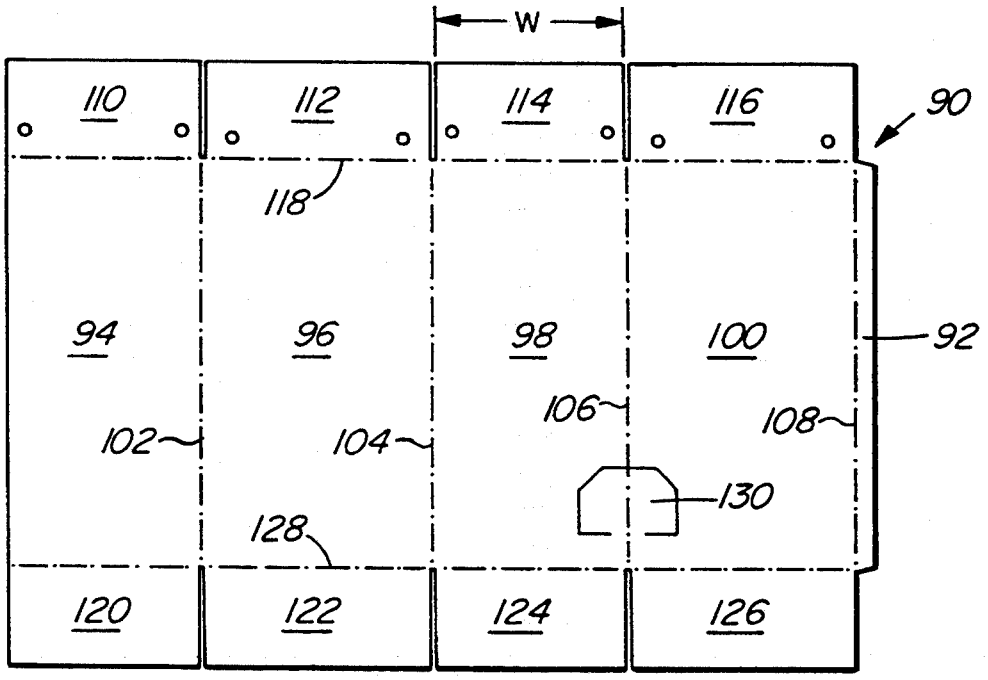
FIG. 3 is a plan view of a blank adapted to form an outer rectangular sleeve.

An outer sleeve 90A (see FIG. 6) is formed from a blank 90 (see FIG. 3) having a glue flap 92, the plurality of wall forming panels 94, 96, 98 and 100 foldably interconnected by a set of substantially parallel fold lines 102, 104, 106 and 108.

Each of the wall forming panels 94, 96, 98 and 100 is provided with its respective top flap, 110, 112, 114 and 116 connected thereto via a fold line 118 and are similarly provided with bottom flaps 120, 122, 124 and 126 respectively connected thereto via a fold line 128.

The fold line 118 and 128 are substantially parallel and are substantially perpendicular to the fold line 102, 104, 106 and 108.

The spacing between the fold lines 118 and 128 which defines the length of the sleeve 90A formed from the blank 90 is such that the top and bottom flaps fold over in line with the tops and bottoms of the telescoped sleeves 10A and 60A.

The blank 90 is provided with an access cutout as indicated at 130 which may be removed or moved out of the way to provide access to the fitment (not shown) but which is intended to be received within the fitment receiving formations 82 and 88 in the blanks 60 and 10.

It will be apparent that the blank 90 forms a rectangle sleeve that is adapted to snugly receive the sleeves formed from the pair of telescoped sleeves formed from the blanks 10 and 60.

It will be noted that when the flap 40 or 40B are folded into position (see FIG. 4), the notch or step 50 comes into a butting relationship with the edges 52 and 80.

Figure 4:
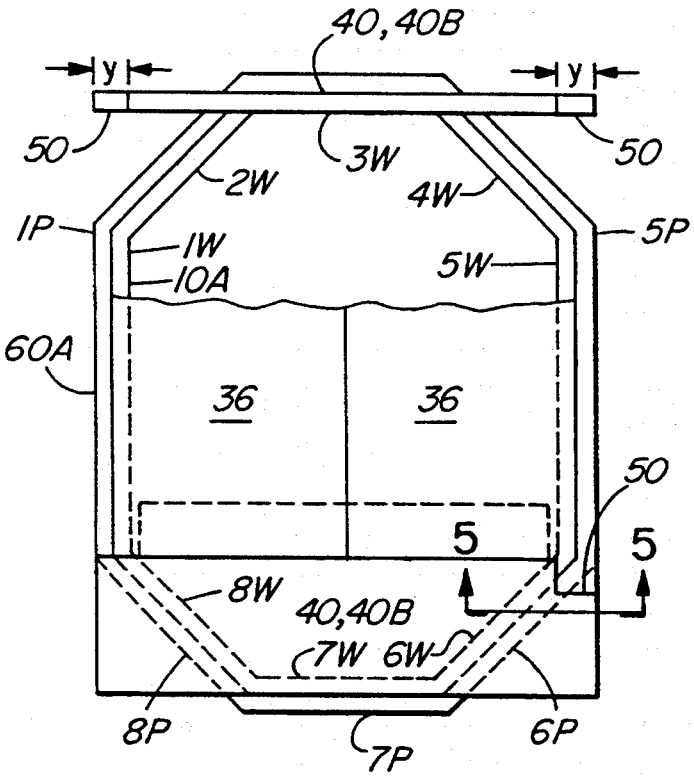
FIG. 4 is a top plan view of the carton with parts broken away and showing the inter-relationship of the wide flaps with the notched corner.
Figure 5:
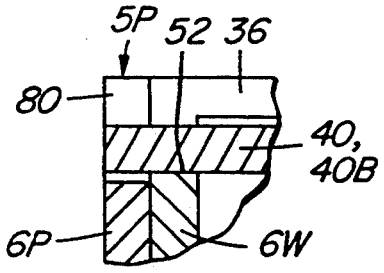
FIG. 5 is a section along the line 5—5 of FIG. 4.

It will be noted that the bottom flaps 40B are first folded into position on the center sleeve 10A when it is being erected to hold the sleeve 10A in the erected position. The portions 44 and 46 are folded into substantially parallel relationship with their adjacent walls 2W, 4W, 6W and 8W and the intermediate sleeve 60A is slid over the internal sleeve 10A with the walls properly positioned to form a double walled sleeve as illustrated in FIGS. 4 and 5.

Figure 6:
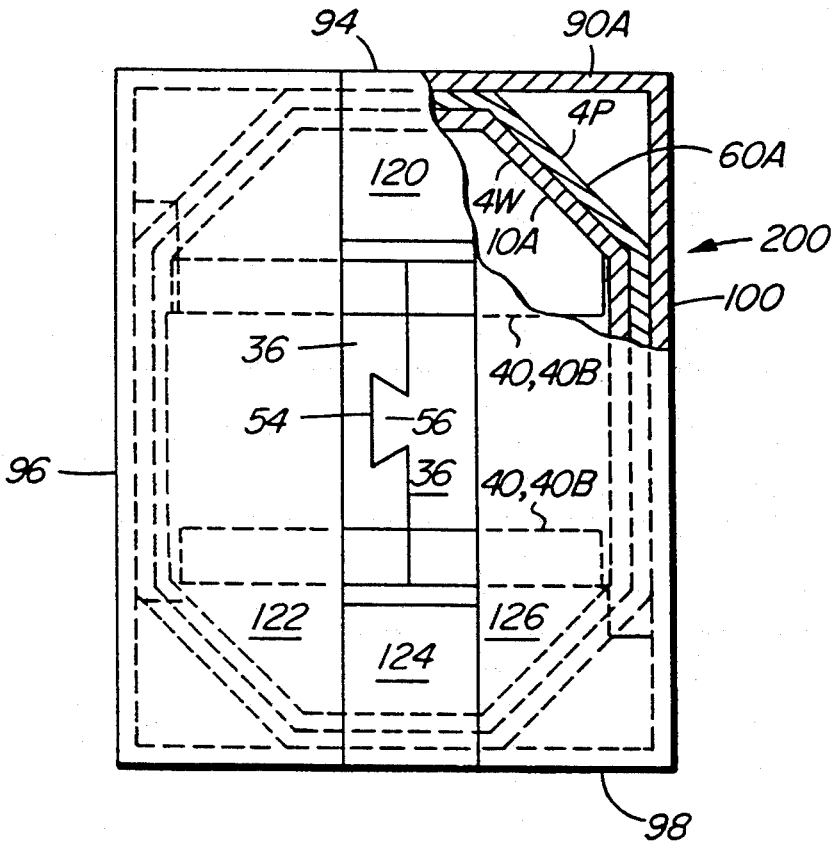
FIG. 6 is a bottom plan of the canon view looking in the opposite axial direction to FIG. 4 with parts broken away to better illustrate the invention.

FIG. 6 which is a view from the bottom shows the interlock of the flaps 36 by the undercut 56 and 54 and the outer sleeve 90A formed from the blank 90 positioned in encircling relationship relative to the pair of telescoping sleeves 10A and 60A. It will be noted that the lateral projections on the flaps 40 and 40B, i.e. the side edge 48, from the steps 50 at the edges of the flap 40 and/or 40B adjacent to its respective wall 2W, 4W, 6W or 8W to interlock the sleeves and ensure they are in their octagonal cross sectional configuration. These flaps 40 and 40A define the outline of opposite ends of a rectangle having a dimension w which is substantially equal to the dimension w shown in FIG. 3 which corresponds to the inside dimension of the sleeve 90A formed from the blank 90.

It will be apparent that when the three sleeves 10A, 60A and 90A are erected and telescoped together they form the container 200. If desired a bag (not shown) or other material may be inserted into the container 200 and filled. The container 200 is closed by closing the top flaps on the sleeve 10A and the flaps on the sleeve 90A.

Having described the invention, modifications will be evident to those skilled in the art without departing from the scope of the invention as defined in the appended claims.

We claim:

1. A container comprising an inner sleeve formed by a plurality of foldably interconnected walls, at least one group of three adjacent of said walls composed of a center wall and a pair of laterally adjacent walls positioned one on each side of the center wall, a flap foldably connected to said center wall along one end thereof, said flap having a width wider than said center wall and extending symmetrically laterally on opposite sides of said center wall, a step formed on each lateral edge of said flap, said set of three walls being shorter than immediately adjacent walls of said inner sleeve positioned on the sides of said laterally adjacent walls remote from said center wall thereby to provide a pair of abutment edges one formed at the end of each of said immediately adjacent walls by an edge of each of said immediately adjacent walls adjacent to said step and flap, said the widths of each of said laterally adjacent walls and the angles between the walls of said group of walls being correlated to ensure that an edge formed by each of said steps is in a substantially abutting relationship with its respective adjacent of said abutment edges when said sleeve is erected and said flap is folded into a position substantially perpendicular to the axis of said sleeve.

2. A container as defined in claim 1 further comprising a second sleeve surround said inner sleeve, panels forming walls said second sleeve, said panels forming walls corresponding to and overlying said laterally adjacent walls of said inner sleeve each having a length measured axially of said sleeve shorter than their respective adjacent panels forming walls to form second pair of abutment edges at an end of said second sleeve adjacent to said flap and one of said second pair of abutment edges being formed by a side of its respective of a pair of adjacent panels positioned on opposite sides of and adjacent to said short panel, one of said second pair of abutment edges at one side of said short panel being in position to engage said stepped lateral edges.

3. A container as defined in claim 2 further comprising a rectangular cross section outer sleeve encircling said second sleeve and wherein said wide flap is substantially rectangular with one edge defined along a central portion thereof by a fold line connecting said flap with its respective said center wall and said wide flap have a width corresponding in width to a wall panel of said rectangular cross section outer sleeve.

4. A container as defined in claim 2 wherein said second sleeve has a corresponding number of panels forming walls to those in said inner sleeve and is provided with short walls corresponding with each of said short walls of said inner sleeve.

5. A container as defined in claim 1 wherein said inner sleeve forms a substantially octagonal cross-section and two of said group of three walls are positioned in opposed mirror relationship to each other across said inner sleeve.

6. A container as defined in claim 2 wherein said inner sleeve forms a substantially octagonal cross-section and two of said group of three walls are positioned in opposed mirror relationship to each other across said inner sleeve.

7. A container as defined in claim 3 wherein said inner sleeve forms a substantially octagonal cross-section and two of said group of three walls are positioned in opposed mirror relationship to each other across said inner sleeve.

8. A container as defined in claim 4 wherein said inner sleeve forms a substantially octagonal cross-section and two of said group of three walls are positioned in opposed mirror relationship to each other across said inner sleeve.

* * * * *